United States Patent [19]

Taylor

[11] 3,947,896

[45] Apr. 6, 1976

[54] DOUBLE FACED ADHESIVE DEVICE FOR HOLDING A WOMAN'S SLIP

[76] Inventor: George F. Taylor, P.O. Box 625, Moultrie, Ga. 31768

[22] Filed: Aug. 8, 1974

[21] Appl. No.: 495,560

Related U.S. Application Data

[62] Division of Ser. No. 281,161, Aug. 16, 1972, abandoned.

[52] U.S. Cl. ..... 2/217; 2/74; 2/211; 2/269; 24/DIG. 11; 428/343; 428/195

[51] Int. Cl.[2] ..... A41D 1/14

[58] Field of Search ..... 2/217, 211, 74, 269, 52, 2/315, 330; 161/406, 147, 145; 24/DIG. 11; 12/142 R

[56] References Cited

UNITED STATES PATENTS

| | | | |
|---|---|---|---|
| 2,060,906 | 11/1936 | Snyder | 24/DIG. 11 |
| 2,079,426 | 5/1937 | Schottenfels | 24/DIG. 11 |
| 2,173,972 | 9/1939 | Lane | 161/147 X |
| 2,173,989 | 9/1939 | Wilbur | 161/147 X |
| 3,257,677 | 6/1966 | Batchelder et al. | 24/DIG. 11 |
| 3,257,678 | 6/1966 | Batchelder et al. | 12/142 R |
| 3,677,250 | 7/1972 | Thomas | 24/DIG. 11 |
| 3,852,823 | 12/1974 | Jones | 161/406 |

FOREIGN PATENTS OR APPLICATIONS

| | | | |
|---|---|---|---|
| 626,328 | 5/1927 | France | 2/217 |

*Primary Examiner*—H. Hampton Hunter
*Attorney, Agent, or Firm*—Newton, Hopkins & Ormsby

[57] ABSTRACT

A device adapted to be attached to and between a woman's skirt and slip adjacent lower edges thereof at spaced locations to prevent the slip from being displaced upwardly while being worn. The device is constructed of a strip of material having opposite surface portions, with adhesive means applied to the opposite surface portions, whereby one surface portion can be attached by the adhesive means to the slip and the other surface portion can be attached by the adhesive means to the skirt. Cover means is provided over the adhesive means to prevent unwanted contact with the adhesive means prior to use, with the cover means being provided with gripping portions to permit easy removal of the cover means when desired. One embodiment of the strip material is constructed as an elongated flexible element with the adhesive means being applied to one surface portion adjacent one end and additional adhesive means being applied to an opposite surface portion adjacent an opposite end, with an area therebetween free of adhesive material. The flexible area will permit lateral displacement of the skirt relative to the slip, such as when the flare in the skirt is greater than the flare in the slip. The attachment devices are constructed of a number of colors which can be chosen to match the color of the slip and skirt being worn by the individual.

4 Claims, 6 Drawing Figures

DOUBLE FACED ADHESIVE DEVICE FOR HOLDING A WOMAN'S SLIP

This is a division of application Ser. No. 281,161, filed Aug. 16, 1972, now abandoned.

BACKGROUND OF THE INVENTION

This invention relates to a method and means for holding a woman's slip in alignment relative to the skirt.

More particularly, this invention is directed to the application of a number of double-faced adhesive strips of material between the skirt and slip adjacent the lower edge thereof at spaced locations, whereby the slip will be attached to the skirt to prevent the slip from riding upward beneath the skirt.

A woman's daily wearing apparel often includes a skirt having a slip worn thereunder. Due to the materials of which the slip and skirt are constructed and due to natural body movements of the woman while wearing the skirt and slip, the slip will often be displaced upwardly beneath the skirt, rendering the garments uncomfortable during wear and often creating an unattractive display of the garments.

Prior art devices have been devised for maintaining one garment in alignment relative to another garment. However these prior art devices are constructed of connecting elements which are expensive to manufacture and time consuming in their application to the garments. One type of prior art connecting device includes buttons and complementary button holes which are attached to adjacent garments and adapted to be connected to each other during wear. Button connecting means are bulky in nature and are not feasible for attachment between a lady's slip and skirt for maintaining the slip in proper alignment relative to the skirt.

SUMMARY OF THE INVENTION

The above stated disadvantages and problems arising out of wearing a skirt with a slip thereunder are overcome by the present invention which basically includes a strip of flexible material having opposite surface portions, with adhesive means applied to one surface portion and adhesive means being applied to an opposite surface portion whereby one surface portion can be attached by the adhesive means to the slip and the other surface portion can be attached by the other adhesive means to the skirt. Cover means having readily available gripping means are provided over the adhesive means for preventing unwanted contact with the adhesive means prior to use.

One embodiment of the connecting devices is constructed in the form of an elongated strip having spaced surface portions connected by a flexible area of reduced size, with adhesive means being applied to one surface of one of the connecting portions and with adhesive means being applied to an opposite surface of the other connecting portion, whereby the flexible area between the adhesive portions will permit lateral displacement of the skirt relative to the slip, due to the variation in the flare between the two garments.

It is therefore a primary object of the present invention to provide means for holding a woman's slip in proper alignment relative to a woman's skirt while they are being worn.

A further object of this invention is to provide a device adapted to be attached between adjacent garments worn by a person to maintain proper alignment of the garments.

Another object of this invention is to provide a double-faced adhesive strip of material adapted to be attached between adjacent garments for maintaining proper alignment of the garments.

Still another object of this invention is to provide a strip of material having adhesive means on opposite surface portions, with readily removable cover means applied to the adhesive means.

A still further object of this invention is to provide an attachment device which can be attached between a woman's slip and a woman's skirt in a manner to permit lateral displacement of the skirt relative to the slip due to the variation in flare of the garments.

Yet another object of this invention is to provide a strip of material adapted to be attached between a skirt and slip for holding the slip in proper alignment, wherein the attachment device is constructed of a color which would be compatible with the color of the garments being worn.

An additional object of this invention is to provide an attachment device which can be placed between adjacent garments worn by a person to maintain proper alignment of the garments, which attachment device is simple in construction and application, economical to manufacture and reliable in performance.

These and other objects and advantages of the details of construction will become apparent upon reading the following descriptions of the illustrative embodiments of the invention, with reference to the attached drawings wherein like reference numerals have been used to refer to like parts throughout the several figures, and wherein:

DESCRIPTION OF THE ILLUSTRATIVE EMBODIMENTS

Figure 1:
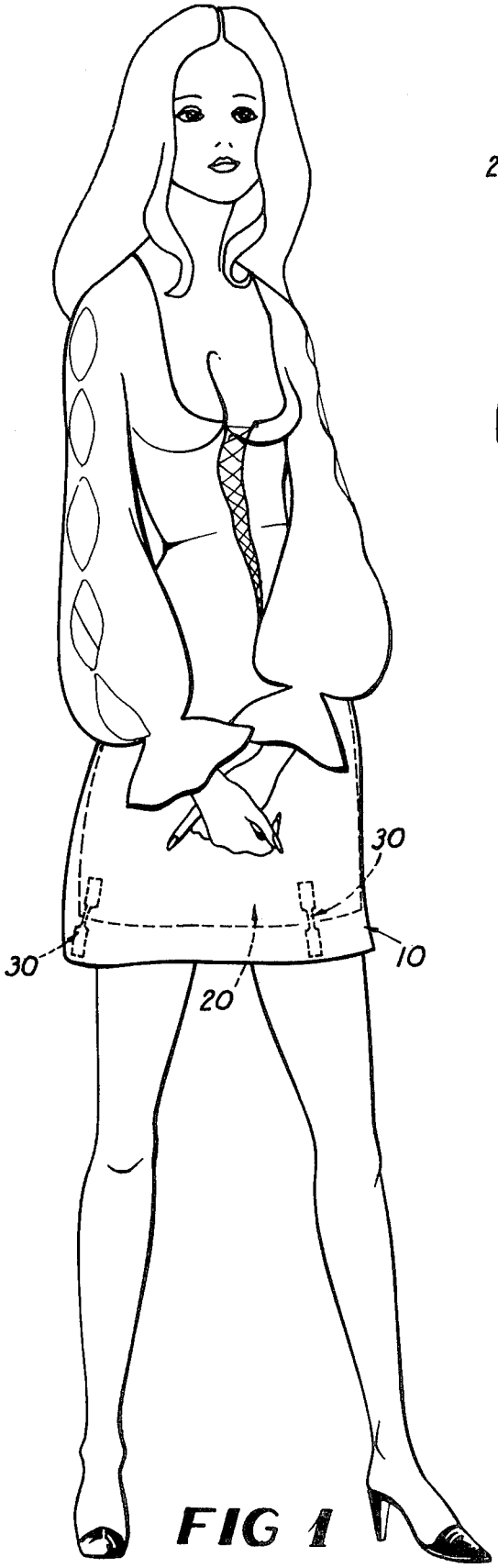
FIG. 1 is an elevational view of a woman's skirt and slip being worn with attachment devices embodying the principles of the present invention being attached thereto, with the attachment devices being shown in dotted lines.

Referring now particularly to FIG. 1 of the drawing, the attachment devices of the present invention will be described relative to a lady's skirt generally represented by the reference numeral 10 and a lady's slip represented by the reference numeral 20, with a plurality of attachment devices 30 attached therebetween for holding the slip down in proper alignment adjacent the lower edge of the woman's skirt.

Figure 2:
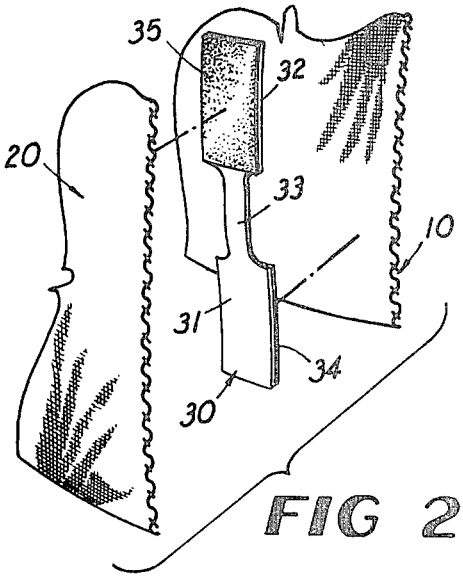
FIG. 2 is an enlarged exploded perspective view showing one embodiment of an attachment device embodying the principles of the present invention with fragmentary portions of a skirt and slip.
Figure 3:
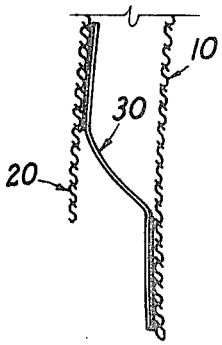
FIG. 3 is a vertical sectional view taken through a woman's skirt and slip adjacent one of the attachment devices, showing the attachment device attached in position to the skirt and slip.
Figure 4:
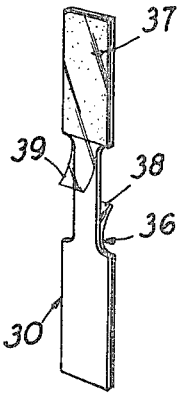
FIG. 4 is a perspective view of the attachment device shown in FIGS. 2 and 3, with cover means being applied thereto, prior to use.

As shown in FIGS. 2–4, a first embodiment of the attachment device 30 is constructed of an elongated flexible strip of material, such as plastic or other suitable material having the desired flexible and elastic characteristics. The elongated strip 30 is provided with a first end portion 31 and a second end portion 32. The end portions 31 and 32 are interconnected by an integrally formed connecting portion 33. The connecting portion 33 is of reduced dimension as compared with the end portions 31, 32 for the purpose of giving more flexibility of movement between the end portions. As shown in FIGS. 2–4, each of the end portions 31, 32 are provided with opposite surface portions, with one of the surfaces of end portion 31 having applied thereto an adhesive material 34 and with an opposite surface of end portion 32 being applied with an adhesive material 35.

In an assembled or attached relationship, as shown in FIG. 3, end portion 31 is attached to the inside lower edge of the skirt 10 by engaging the adhesive material 34 with the skirt material. The end portion 32 of the elongated strip is attached to the slip 20 by engaging the adhesive portion 35 to the outer surface of the slip. The elongated connecting strip 30 with flexible connecting strip 33, which may also be elastic, will permit the skirt 10 to be displaced laterally away from the slip 20, due to the variations in flare characteristics between the skirt and slip, but will still effectively hold the slip down in proper alignment relative to the lower edge of the skirt.

As shown in FIG. 4, the elongated strip 30 is provided with cover elements 37, 38 detailed for covering or overlying the adhesive material 34, 35, respectively, prior to use or attachment of the elongated strip to the skirt and slip. Each of the cover elements 36, 37 are provided with tab portions 38, 39, respectively, which are shaped to permit an individual to grip the same for removing the cover from the adhesive surfaces prior to attaching the strips to the skirt and slip.

Figure 5:
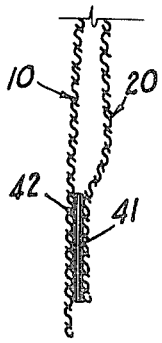
FIG. 5 is a vertical sectional view taken through a woman's skirt and slip adjacent an alternate embodiment of an attachment device embodying the principles of the present invention; and, FIG. 6 is an enlarged perspective view of the attachment device shown in FIG. 5, showing cover means in position on the adhesive means.
Figure 6:
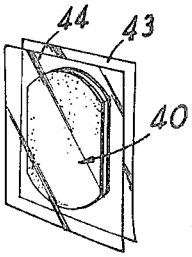

Referring now particularly to FIGS. 5 and 6, an alternate form of the attachment device is shown and generally represented by reference numeral 40. The attachment device 40 is constructed in the form of a rectangular shape having rounded end portions. The strip construction of the attachment device 40 is provided with opposite surfaces which have applied thereto adhesive material 41, 42, as shown in FIG. 5. The adhesive material 41, 42 is of conventional composition and detailed for sticking the skirt and slip to the attachment device to prevent relative movement therebetween. The two adhesive applied surface portions 41, 42 are provided with removable cover means 43, 44, respectively, which are provided for overlying and covering the adhesive material to prevent unwanted contact. The cover means 43, 44 are detailed in dimensions to provide projecting gripping portions which will permit an individual to remove the cover portions prior to attachment of the strip in position between a skirt and slip. As shown in FIG. 5, the attachment strip 40 is secured to the skirt 10 and slip 20 in a manner as described hereinabove in regard to the elongated strip 30, with one adhesive surface portion 41 being contacted and pressed against the slip 20 and with an opposite adhesive surface portion 42 being contacted and pressed against the skirt 10.

The elongated strip 30 and rectangular strip 40 described hereinabove are both constructed of suitable flexible material which may be synthetic, such as plastic, and the adhesive compound applied to the strip surface portions is of conventional composition which would allow the attachment devices 30, 40 to be readily attached to and removed from garments being worn such as a lady's slip or skirt. In the construction of the attachment devices 30, 40, these devices are formed of a number of colors, which colors would be compatible and attractive in appearance with the garments to which they are being attached.

It now becomes apparent that the illustrative embodiments described herein are capable of obtaining the above stated objects and advantages. It is obvious that those skilled in the art may make modifications in the details of construction without departing from the spirit of the invention which is to be limited only by the scope of the appended claims.

What is claimed is:

1. In combination with an outer garment and an inner garment worn by a person, one of which garments tends to "ride" up with respect to the other, a device attached to and between said garments, said device constructed of a strip of material having opposite surface portions, with adhesive means applied to said opposite surface portions, whereby one surface portion is attached by said adhesive means to one garment and said other surface portion is attached by said adhesive means to said other garment.

2. In the combination as defined in claim 1 wherein readily removable cover means having gripping projections are applied to the adhesive surfaces to prevent unwanted contact prior to use.

3. In the combination as defined in claim 2 further characterized in that said strip of material is constructed in the form of an elongated flexible strip, with said adhesive means applied to said one surface portion being located adjacent one end of said elongated strip and said adhesive means applied to said other surface portion being located adjacent an opposite end of said elongated strip with said strip including an area between said adhesive means on both of said surface portions which are free of adhesive means for providing limited relative lateral displacement or spacing of one garment relative to said other garment.

4. In the combination as defined in claim 3 further characterized in that said portion of said elongated strip between said adhesive applied surfaces is constructed of reduced dimensions which will permit flexing movement between said adhesive applied portions.

* * * * *